United States Patent [19]

Gesswein et al.

[11] 4,268,594

[45] May 19, 1981

[54] METHOD OF MANUFACTURING A FLUORESCENT SCREEN

[76] Inventors: Eberhard Gesswein, Erenäcker 20; Werner Möller, Ravensburger Strasse 77, both of D-7900 Ulm, Fed. Rep. of Germany

[21] Appl. No.: 141,259

[22] Filed: Apr. 17, 1980

Related U.S. Application Data

[63] Continuation of Ser. No. 918,440, Jun. 23, 1978, abandoned.

[30] Foreign Application Priority Data

Jul. 9, 1977 [DE] Fed. Rep. of Germany ..... 2731126

[51] Int. Cl.[3] ..... G03C 5/00; G03C 7/00

[52] U.S. Cl. ..... 430/24; 430/23; 430/26; 430/27; 430/28; 430/29; 430/156; 430/327; 313/470; 313/472; 313/473; 427/68

[58] Field of Search ..... 430/24, 26, 27, 28, 430/29, 156, 327, 23; 427/68; 313/470, 472, 473

[56] References Cited

U.S. PATENT DOCUMENTS

| | | | |
|---|---|---|---|
| 2,827,390 | 3/1958 | Garrigus | 430/24 |
| 3,005,708 | 10/1961 | Hesse | 430/24 |
| 3,114,065 | 12/1963 | Kaplan | 313/472 |
| 3,317,319 | 5/1967 | Mayaud | 430/28 |
| 3,387,975 | 6/1968 | Tamura | 430/28 |
| 3,484,269 | 12/1969 | Jonkers et al. | 430/24 |
| 3,712,815 | 1/1973 | Rohrer et al. | 427/68 |
| 3,726,678 | 4/1973 | Robinder | 430/27 |
| 3,886,394 | 5/1975 | Lipp | 313/473 |
| 3,891,440 | 6/1975 | Gallaro et al. | 430/27 |
| 3,915,707 | 10/1975 | Gesswein | 430/28 |
| 3,932,183 | 1/1976 | Fisher et al. | 430/27 |
| 3,965,278 | 6/1976 | Duinker et al. | 430/28 |
| 4,019,905 | 4/1977 | Tomita | 430/23 |

FOREIGN PATENT DOCUMENTS

| | | |
|---|---|---|
| 1462583 | 11/1968 | Fed. Rep. of Germany . |
| 1487737 | 1/1969 | Fed. Rep. of Germany . |
| 2409026 | 11/1974 | Fed. Rep. of Germany . |

*Primary Examiner*—Charles L. Bowers, Jr.
*Attorney, Agent, or Firm*—Spencer & Kaye

[57] ABSTRACT

A method of manufacturing a fluorescent screen for color picture tubes comprises applying to the tube front plate a continuous sensitized filter layer and exposing it, applying a continuous sensitized fluorescent layer and exposing it through a mask and removing the unexposed parts of the fluorescent layer and the filter layer therebeneath by washing.

18 Claims, No Drawings

METHOD OF MANUFACTURING A FLUORESCENT SCREEN

CROSS REFERENCE TO RELATED APPLICATION

This application is a continuation of applicant's copending U.S. application Ser. No. 918,440, filed June 23, 1978, now abandoned.

BACKGROUND OF THE INVENTION

The present invention relates to a method of manufacturing a fluorescent screen for colour picture cathode ray tubes in which at least two patterns of the fluorescent material layer which are adjacent to each other are applied photochemically to the glass front plate of the tube and a pattern of the filter layer which is substantially everlaid with the corresponding pattern of the fluorescent material is also applied photochemically at least between a pattern of the fuorescent material layer and the front plate.

With colour picture cathode ray tubes, it is already known to assign colour filter layer parts to the individual fluorescent material layer elements of the fluorescent screen (U.S. Pat. No. 3,726,678, U.S. Pat. No. 3,114,065, German Offenlegungsschrift No. 24 42 167). The patterned application of the fluorescent materials for these fluorescent screens is undertaken as is known by using photochemical methods whereby polyvinyl alcohol, sensitized with ammonium bichromate, is used chiefly as the light-sensitive binding agent. The patterned exposure usually takes place with UV light.

Furthermore it is known that the patterns for the fluorescent material can either be punctiform or in strips.

It is further known for the manufacture of fluorescent screens for colour picture cathode ray tubes to use a diazonium compound as a sensitizer for the polyvinyl alcohol (German Offenlegungsschrift No. 22 57 920 and German Offenlegungsschrift No. 23 10 617).

With methods of manufacturing fluorescent screens having filter layers as described, for example, in German Offenlegungsschrift No. 24 42 167, colour filter layers are applied in the same manner as individual fluorescent material layers and this means that exactly the same operating processes are necessary for each colour filter layer as are necessary to apply the fluorescent material layers in each case. It is particularly expensive to carry out the necessary insertion and removal of the shadow mask during exposure in order to produce the desired pattern.

SUMMARY OF THE INVENTION

It is an object of the present invention to provide a new method of the type stated at the outset which is substantially simplified with respect to its application and which permits manufacture of filter layer parts which have a very good matching to the contours of the fluorescent material parts as regards their contours.

According to the invention, there is provided a method of manufacturing a fluorescent screen for colour picture tubes comprising applying a continuous sensitized filter layer to the tube front plate exposing said filter layer, applying to said filter layer a continuous sensitized fluorescent layer, exposing said fluorescent layer through a mask and removing the unexposed parts of said fluorescent layer and the parts of said filter layer therebeneath by washing.

Further according to the invention, there is provided a method of manufacturing a fluorescent screen for colour picture cathode ray tubes in which at least two adjacent patterns of the layer of fluorescent material are applied photochemically to the glass front plate of the tube and a pattern of the filter layer which is substantially overlaid with the corresponding pattern of the fluorescent material layer is also applied photochemically at least between one pattern of said fluorescent material layer and said front plate, characterized in that initially a continuous filter layer is applied as an aqueous suspension made of filtering material and a binding agent sensitized by means of a first sensitizer and said filter layer is dried; that said filter layer is then exposed evenly for a short time; that a continuous fluorescent material layer is then applied as an aqueous suspension made of fluorescent material and of a binding agent sensitized by a second sensitizer and said fluorescent layer is then dried; that said fluorescent layer is then exposed by a mask which is arranged in front of said fluorescent layer and has the desired pattern and that the parts of said fluorescent layer which have not been exposed and the parts of the filter layer lying therebelow are removed in a washing process.

DESCRIPTION OF THE PREFERRED EMBODIMENTS

Embodiments of the invention will now be described by way of example.

In a method of manufacturing a fluorescent screen for colour picture cathode ray tubes as stated at the outset, the invention proposes that initially a continuous filter layer be applied as an aqueous suspension made up of filter material and a binding agent sensitized with a first sensitizer and this filter layer is dried; this filter layer is then evenly exposed for a short time; then a continuous fluorescent material layer is applied as an aqueous suspension made up of fluorescent material and a binding agent sensitized with a second sensitizer and is then dried and the fluorescent material layer is then exposed by a mask which is arranged in front thereof and has the desired pattern and that the parts of the fluorescent material layer and parts of the filter layer lying thereunder which have not been exposed are removed in a washing process.

A substantial advantage of the method described may be seen in the fact that separate exposure of the filter layer through a patterned mask is not necessary whereby the method of manufacture is made substantially easier. A further advantage of the invention may be seen in the fact that owing to the uniform intermediate exposure, very good dosing of the exposure is required so that extremely thin filter layers can be manufactured. A further advantage of the method described lies in the fact that, in a simple manner, it is possible to assign a filter layer only to one part of the three patterns of the fluorescent material layer normally used. Similarly the method described permits, in a simple manner, the allocation of a filter layer, for example two patterns of the fluorescent material layer of different emission colour.

With a preferred embodiment, operation was as follows:

Initially a suspension was mixed which contains polyvinyl alcohol sensitized with ammonium bichromate as a binding agent and also contains a desired colour pigment. The suspension comprises 40 g ultramarine blue in approximately 20 ml solution containing 5% polyvinyl alcohol for the blue filter colour layer. The suspension contained five drops of a moistening agent moreover, such as Pluronic L 62 and 15 ml of a solution having 25% ammonium bichromate. After this mixture was ground in a ball mill, this suspension was diluted again approximately in the ratio 1:8 and then approximately 40 ml was sprayed on to the front shell of the colour picture tube. Thus an approximately 1 to 3μ thick colour filter layer was achieved having a mean grain size of approximately 0.1μ. After drying this suspension layer it was exposed for approximately one second by a UV flashlight over a large area.

The appropriate suspension, in this case the blue fluorescent material suspension, is now applied to this colour filter layer exposed over a large area and the suspension contains polyvinyl alcohol sensitized with a diazonium compound as a binding agent. Those diazonium compounds which are particularly suitable for this purpose are described in German Offenlegungsschrift No. 23 10 617. After applying and drying the fluorescent material layer in known manner, the fluorescent material layer is then exposed to UV light through a shadow mask whereby the exposed parts are not soluble in water and the filter layer lying thereunder is reexposed. Afterwards the shadow mask is removed and the front shell is subjected to a washing process in one or more stages. In each case diluted hydrogen peroxide, more particularly approximately 10% over a period of time of approximately ¼ to four minutes is used.

With the two-stage method after exposure and removal of the shadow mask washing takes place first of all with water of approximately 30° C. The parts of the fluorescent material layer which have not been exposed during exposure through the shadow mask are removed during this washing process. Subsequently washing takes place with a solution having approximately 10% hydrogen peroxide whereby the parts of the filter layer which were exposed by the first washing process are removed. It has been proved that the parts of the filter layer which are located under the remaining parts of the fluorescent material layer are not noticeably attached by the washing process with hydrogen peroxide. In addition it is advisable if subsequent washing with water takes place again.

In a single-stage washing process immediately after exposure of the fluorescent material layer and removal of the shadow mask, washing takes place with a diluted hydrogen peroxide solution whereby the parts of the fluorescent material layer not exposed and the parts of the filter layer lying thereunder are removed. In accordance with a preferred embodiment, a complexing agent is added to the hydrogen peroxide washing solution. Preferred complexing agents are EDTA (ethylenediaminetetra-acetic acid), ethylene diamine, triethanolamine. The complexing agents are preferably used in the alkaline range in which some ammonia is added to the complexing agents, for example.

It will be understood that the above description of the present invention is susceptible to various modification changes and adaptations.

What is claimed is:

1. A method of manufacturing a fluorescent screen for color picture cathode ray tubes in which at least two adjacent patterns of the layer of particulate fluorescent material are applied photochemically to the glass front plate of the tube and a pattern of the filter layer which is substantially overlaid with the corresponding pattern of the fluorescent material layer is also applied photochemically at least between one pattern of said fluorescent material layer and said front plate, said filter layer being of a material which exhibits a relatively high transmission efficiency for light in a spectral range including the color emitted by the fluorescent material applied over the filter layer and a relatively low transmission efficiency for light in the remainder of the visible spectrum, characterized in that initially a continuous filter layer is applied as an aqueous suspension made of particulate filtering material and a binding agent sensitized by means of a first photosensitizer and said filter layer is dried; that said entire filter layer is then exposed evenly to actinic light for a short time; that a continuous fluorescent material layer is then applied as an aqueous suspension made of fluorescent material and of a binding agent sensitized by a second photosensitizer which differs from said first photosensitizer and said fluorescent layer is then dried; that said fluorescent layer is then exposed to actinic light by a mask which is arranged in front of said fluorescent layer and has the desired pattern and that the parts of said fluorescent layer which have not been exposed and the parts of the filter layer lying therebelow are removed in a washing process.

2. A method as defined in claim 1, and comprising using polyvinyl alcohol as a binding agent.

3. A method as defined in claim 1 and comprising using polyvinyl alcohol sensitized with ammonium bichromate to apply said filter layer.

4. A method as defined in claim 1 and comprising using polyvinly alcohol sensitized with a diazonium compound to apply said fluorescent material layer.

5. A method as defined in claim 4, and comprising using a 3-alkoxy-diphenylamine-4-diazonium salt condensate as a said diazonium compound.

6. A method as defined in claim 1, and comprising removing the unexposed parts of said fluorescent layer with water in a first washing process and removing the parts of said filter layer thus exposed with a diluted hydrogen peroxide solution.

7. A method as defined in claim 6, and comprising adding a complexing agent to the hydrogen peroxide solution.

8. A method as defined in claim 7, and comprising using EDTA as said complexing agent.

9. A method as defined in claim 1 and comprising removing the unexposed parts of said fluorescent layer and the parts of said filter layer lying thereunder in a single-stage washing process by using aqueous diluted hydrogen peroxide.

10. A method as defined in claim 9, and comprising adding a complexing agent to the washing solution.

11. A method as defined in claim 10, and comprising using EDTA as said complexing agent.

12. A method as defined in claim 1 wherein exposure takes place with UV light.

13. A method as defined in claim 7 and comprising using a mixture made up of hydrogen peroxide and said complexing agent in an alkaline medium.

14. A method as defined in claim 10, and comprising using a mixture made up of hydrogen peroxide and said complexing agent in an alkaline medium.

15. A method of manufacturing a fluorescent screen for color picture tubes comprising: applying a continuous photosensitized particulate filter layer to the tube front place, said filter layer being of a material which exhibits a relatively high transmission efficiency for light in a spectral range including the color emitted by the fluorescent material applied over the filter layer and a relatively low transmission efficiency for light in the remainder of the visible spectrum, exposing said entire filter layer to actinic light, applying to said filter layer a continuous photosensitized particulate fluorescent layer which is photosensitized by a photosensitizer which differs from that used in the filter layer, exposing said fluorescent layer to actinic light through a mask and removing the unexposed parts of said fluorescent layer and the parts of said filter layer therebeneath by washing.

16. A method of manufacturing a fluorescent screen for color picture tubes consisting essentially of: applying a continuous photosensitized particulate filter layer to the tube front plate, said filter layer being of a material which exhibits a relatively high transmission efficiency for light in a spectral range including the color emitted by the fluorescent material applied over the filter layer and a relatively low transmission efficiency for light in the remainder of the visible spectrum, exposing said entire filter layer to actinic light, applying to said filter layer a continuous photosensitized particulate fluorescent layer which is photosensitized by a photosensitizer which differs from that used in the filter layer, exposing said fluorescent layer to actinic light through a mask and removing the unexposed parts of said fluorescent layer and the parts of said filter layer therebeneath by washing.

17. The method according to any one of claims 1, 15 or 16 wherein the filter layer is photosensitized with ammonium bichromate and the fluorescent material layer is photosensitized with a diazonium compound.

18. The method according to claim 17 wherein the filter layer and fluorescent material layer contain polyvinyl alcohol as a binding agent.

* * * * *

UNITED STATES PATENT AND TRADEMARK OFFICE

CERTIFICATE OF CORRECTION

PATENT NO. : 4,268,594

DATED : May 19th, 1981

INVENTOR(S) : Eberhard Gesswein et al

It is certified that error appears in the above—identified patent and that said Letters Patent is hereby corrected as shown below:

In the heading of the patent, please insert the following:

--[73] Assignee: Licentia Patent-Verwaltungs G.m.b.H., Frankfurt am Main, Federal Republic of Germany--

Signed and Sealed this

*Twenty-ninth* Day of *September 1981*

[SEAL]

*Attest:*

GERALD J. MOSSINGHOFF

*Attesting Officer*

*Commissioner of Patents and Trademarks*